United States Patent [19]

M'Sadoques

[11] 4,201,439

[45] May 6, 1980

[54] METER JAW AND SPRING CLIP ASSEMBLY

[75] Inventor: Andre J. M'Sadoques, Southington, Conn.

[73] Assignee: General Electric Company, New York, N.Y.

[21] Appl. No.: 970,427

[22] Filed: Dec. 18, 1978

[51] Int. Cl.[2] ..... H01R 11/22

[52] U.S. Cl. ..... 339/259 R; 339/253 R; 339/256 R; 339/259 F

[58] Field of Search ..... 339/251, 252 R, 252 S, 339/253 R, 253 S, 256 R, 256 S, 258 R, 259 R, 259 F

[56] References Cited

U.S. PATENT DOCUMENTS

| | | | |
|---|---|---|---|
| 2,666,189 | 1/1954 | Cook | 339/259 R X |
| 3,053,957 | 9/1962 | Duffield | 339/259 F X |
| 3,368,186 | 2/1968 | Benoit et al. | 339/253 R |
| 3,383,645 | 5/1968 | Milanese et al. | 339/256 R X |

*Primary Examiner*—Roy Lake
*Assistant Examiner*—DeWalden W. Jones
*Attorney, Agent, or Firm*—Robert A. Cahill; Walter C. Bernkopf; Philip L. Schlamp

[57] ABSTRACT

A watt-hour meter socket jaw comprises a pair of upstanding contact segments which are engaged by the arms of a C-shaped spring clip. The clip includes an integrally formed tab for guiding a meter stab into electrical engagement between the contact segments. Tabs lanced from the clip arms engage in apertures in the contact segments to securely mount the spring clip to the jaw.

5 Claims, 4 Drawing Figures

METER JAW AND SPRING CLIP ASSEMBLY

BACKGROUND OF THE INVENTION

It is common practice to equip watt-hour meter socket jaws with separate spring clips to insure adequate contact pressure with a meter stab plugged thereinto. Heretofore, such spring clips have been rather complex in configuration and somewhat difficult to assemble onto the jaw. In some cases the spring clip tends to interfere with the convenient assembly and disassembly of the jaw to and from the meter socket.

It is accordingly an object of the present invention to provide an improved watt-hour meter jaw and spring clip assembly.

A further object is to provide a meter jaw and spring clip assembly of the above character, wherein the spring clip is of a simplified construction.

An additional object is to provide an assembly of the above character, wherein adaption of the spring clip to the jaw is facilitated.

Another object of the present invention is to provide an assembly of the above character, wherein the spring clip holds the jaw parts in positive assembly prior to adaption of the jaw to a meter socket.

Yet another object is to provide an assembly of the above character wherein the spring clip is provided with means for guiding a meter stab into electrical engagement with the jaw.

Other objects of the invention will in part be obvious and in part appear hereinafter.

SUMMARY OF THE INVENTION

In accordance with the present invention, there is provided a watt-hour meter jaw having a pair of L-shaped conductive members, each having a base segment and an upstanding contact segment. The base segments are positioned in lapping relation to register apertures therein for receipt of a bolt clamping the jaw in electrical connection with a conductive strip. The contact segments are engaged by the arms of a C-shaped spring clip to exert the requisite contact pressure on a meter stab inserted between the jaw contact segments. Integrally formed with the spring clip intermediate its arms is an upstanding guide tab disposed transversely of the contact segments. This tab is flared away from the contact segments to serve in conjunction with the flared upper ends of the contact segments in directing the insertion of a meter stab into electrical engagement with the jaw between the contact segments. To sustain the jaw and spring clip assembly, the spring clip arms and the contact segments are equipped with interengaging detent means. In the disclosed embodiment, this detent means comprises tabs inwardly lanced from the spring clip arms for engagement in apertures provided in the contact segments.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawing, in which.

Like reference numerals refer to corresponding parts throughout the several views of the drawing.

DETAILED DESCRIPTION

Figure 1:
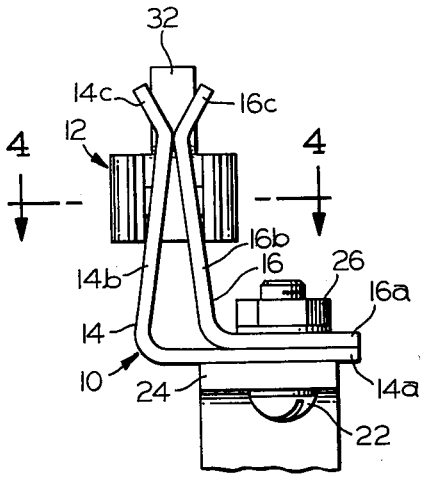
FIG. 1 is an end view of the meter jaw and spring clip assembly of the present invention.

Referring to the drawing, the assembly of the present invention consists of a meter jaw, generally indicated at 10, and a spring clip, generally indicated at 12. The meter jaw includes, as best seen in FIG. 1, a pair of somewhat resilient, generally L-shaped, conductive strips 14 and 16. Strip 14 comprises a base segment **14*a* and an upstanding contact segment 14*b*, while strip 16 comprises a base segment 16*a* and an upstanding contact segment 16*b*. In assembly, base segment 16*a* overlaps base segment 14*a*, and the former is made shorter than the latter such that the contact segments 14*b* and 16*b* are separated at the junctions with their respective base segments. The angular relationships of the contact segments with their respective base segments is established such that the contact segments converge and preferably meet at bends short of their terminal end portions 14*c* and 16*c*, respectively, which are made divergent to facilitate insertion of a meter stab, seen at 18 in FIG. 2**, between the contact segments.

Figure 2:
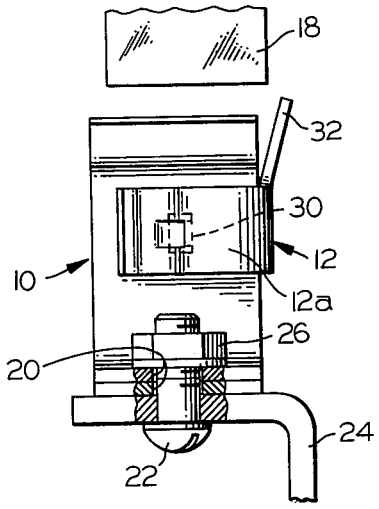
FIG. 2 is a side elevational view, partially broken away, of the assembly of FIG. 1.

As seen in FIG. 2, the lapped base segments are provided with registered holes 20 accommodating the shank of a bolt 22 threadedly engaged in a tapped bore in a conductive strap 24. A nut 26 is threaded down in this bolt shank to clamp strips 14, 16 in electrical connection with strap 24.

Figure 3:
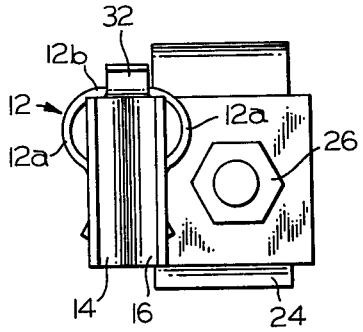
FIG. 3 is a plan view of the assembly of FIG. 1.
Figure 4:
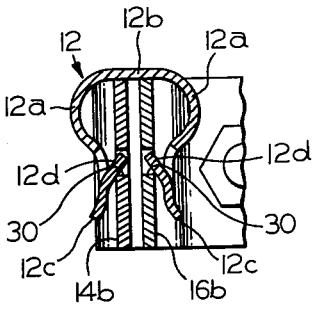
FIG. 4 is a sectional view taken along line 4—4 of FIG. 1.

Spring clip 12, as seen in FIGS. 3 and 4, is C-shaped, having a pair of arms **12*a* interconnected by a bight portion 12*b*. The free end portions 12*c* of the arms are curved away from each other to facilitate assembly of the spring clip 12 to jaw 10 by sliding the arms over the outer surfaces of the contact segments from the side. In addition to imparting the requisite contact pressure of the contact segments 14*b*, 16*b* with a meter stab 18 inserted therebetween, the spring clip serves to maintain strips 14, 16 in assembly prior to being clamped in electrical connection with strap 24. To sustain this assembly, inwardly extending tabs 12d are lanced from the spring clip arms for engagement in slots 30 formed in contact segments 14*b*, 16*b*. It is noted that lanced tabs 12*d* are struck from the arms 12*a* such that their free end extensions are directed toward bight portion 12*b*** of the spring clip. Thus these tabs do not impede assembly of the spring clip to the jaw.

As an additional feature of the present invention, spring clip is provided with an upstanding tab 32 integrally joined with bight portion **12*b*. This tab is positioned transversely of the contact segments 14*b*, 16*b* adjacent one side of the jaw. This tab rises to a height at least equal to and preferably somewhat in excess of the terminations of contact segments 14*b*, 16*b*. Also, as best seen in FIG. 2, tab 32 is angled or flared away from the flared end portions 14*c*, 16*c* of the contact segments. It is seen that, by virtue of this construction, tab 32 functions as a guide, cooperating with the flared end portions 14*c*, 16*c* in directing the insertion of meter stab 18 into proper electrical engagement between contact segments 14*b*, 16*b* of jaw 10**.

It will be appreciated that the detenting action provided by lanced tabs **12*d* and slots 30** may be achieved by reversing the positions. That is, equivalent tabs could be lanced from the contact segments for engagement in slots formed in the spring clip arms.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. In combination:

A. a jaw including (1) a pair of L-shaped conductive strips, (2) each strip including a base segment and an upstanding contact segment, (3) means forming an aperture in each said base segment;

B. a C-shaped spring clip having (1) opposed arms engaging said contact segments to hold said contact segments in juxtaposed relation, whereby said base segments assume a lapped relationship with said apertures in substantial registry to accommodate a bolt clamping said jaw in electrical connection with a conductive member, and (2) an upstanding guide tab on said spring clip integrally located intermediate said arms and arranged transversely of said contact segments to serve in directing the insertion of a stab connector into electrical engagement with said jaw between said contact segments; and C. interengaging detent means formed in said contact segments and said clip arms to hold said contact strips and spring clip in assembly.

2. The combination defined in claim 1, wherein said guide tab extends at least to the height of said contact segments, and is flared somewhat away from said contact segments.

3. The combination defined in claim 2, wherein said detent means includes tabs inwardly lanced from said clip arms and slots formed in said contact segments, each said lanced tab projecting into said slot in the adjacent contact segment.

4. The combination defined in claim 3, wherein said clip arms are provided with outwardly flared free end portions.

5. The combination defined in claim 4, wherein said lanced tabs extend in directions generally away from said clip arm free end portions.

* * * * *